United States Patent [19]

Amstutz et al.

[11] Patent Number: 5,054,863

[45] Date of Patent: Oct. 8, 1991

[54] LIGHTED DISPLAY CASE

[75] Inventors: Douglas D. Amstutz, Muskegon; Ronald A. Vanderboegh, Twin Lakes, both of Mich.

[73] Assignee: Amstore Corporation, Muskegon, Mich.

[21] Appl. No.: 531,555

[22] Filed: Jun. 1, 1990

Related U.S. Application Data

[62] Division of Ser. No. 279,591, Dec. 2, 1988, Pat. No. 4,955,044.

[51] Int. Cl.[5] ..... F16B 12/00

[52] U.S. Cl. ..... 312/111; 312/114; 312/257.1; 312/108

[58] Field of Search ..... 312/140, 107, 108, 111, 312/265.1–265.4, 114, 107.5, 257.1

[56] References Cited

U.S. PATENT DOCUMENTS

| | | | |
|---|---|---|---|
| 661,505 | 11/1900 | Erickson . | |
| 686,524 | 11/1901 | Lowe . | |
| 1,149,140 | 8/1915 | Hess . | |
| 1,764,999 | 6/1930 | Biller . | |
| 1,786,601 | 12/1930 | Cole . | |
| 1,846,485 | 2/1932 | Hart . | |
| 1,870,534 | 8/1932 | Skoogh | 312/140 |
| 1,953,357 | 4/1934 | Leya . | |
| 1,966,964 | 7/1934 | Kennedy . | |
| 2,144,753 | 1/1939 | Erikson . | |
| 2,163,562 | 6/1939 | Putnam et al. . | |
| 2,171,378 | 8/1931 | Urbanek . | |
| 2,336,416 | 12/1943 | Parker . | |
| 2,475,079 | 7/1949 | Clouse et al. . | |
| 2,546,564 | 3/1951 | Roselyn . | |
| 2,559,371 | 7/1951 | Ressinger . | |
| 2,765,544 | 10/1956 | Neveroski, Jr. . | |
| 4,196,952 | 4/1980 | Crowe . | |
| 4,385,850 | 5/1983 | Bobath . | |
| 4,395,080 | 7/1983 | Winn et al. | 312/140 |
| 4,556,148 | 12/1985 | Koller . | |
| 4,844,565 | 7/1989 | Brafford et al. | 312/111 X |
| 4,845,601 | 7/1989 | Podbury et al. . | |

FOREIGN PATENT DOCUMENTS

| | | |
|---|---|---|
| 237729 | 1/1965 | Australia . |
| 2324919 | 12/1974 | Fed. Rep. of Germany . |
| 199301 | 10/1938 | Switzerland . |
| 314632 | 7/1929 | United Kingdom . |

*Primary Examiner*—Joseph Falk

*Attorney, Agent, or Firm*—Warner, Norcross & Judd

[57] ABSTRACT

A display case having a framework, a plurality of panels, and a unique lighting system includes a releasably mounted light fixture, a releasably mounted backfeed housing, and releasably mounted downfeed channel for feeding the cord through the display case. The light fixture, the backfeed housing and the downfeed channel are all capable of being installed and removed without the use of tools. Secondly, a display case assembly involving a pair of adjacent abutting display cases includes a plurality of clips and latches which securely couple the display cases together in a manner which is generally hidden from view.

5 Claims, 8 Drawing Sheets

21

LIGHTED DISPLAY CASE

This is a divisional application of 07279591 now U.S. Pat. No. 4,955,044.

BACKGROUND OF THE INVENTION

The present invention pertains to a display case for effectively and attractively displaying merchandise. Display cases are manufactured in various sizes and shapes to suit different retail needs. Nevertheless, they all generally include front, top and end panels which are transparent to facilitate easy viewing of the merchandise enclosed within. Further, to favorably highlight the merchandise, lighting fixtures are often provided along the upper front edge.

Lighting fixtures typically include an elongated light assembly, preferably utilizing fluorescent lights, which extends across the entire length of the case. The necessary wiring is fed downwardly through the deck by a fixed channel or tube member located near one end panel. An example of such a construction is disclosed in copending U.S. patent application Ser. No. 161,902 filed Feb. 29, 1988, and entitled LIGHTED DISPLAY CASE.

As can be readily appreciated, the panels through use become marred and scratched. In response to this gradual degradation, many retailers periodically replace the panels to continue giving the display cases a fresh, new look. In fact, many retailers install new panels as frequently as every six months.

However, with the construction of past display cases, replacement of the front and end panels requires extensive disassembly of the case. For example, replacement of the front panel will in many instances require removal of the lighting assembly which, in turn, requires removal of the top panel. Furthermore, replacement of the end panel adjacent the wiring channel or tube will often necessitate removal of the front panel in addition to the top panel and lighting assembly. This can be a particularly onerous task if the end panel is the only panel needing replacement.

Also, in use, display cases are frequently arranged end-to-end in a linear or non-linear configuration to make effective use of the available space and/or to more aesthetically arrange a retail area. In any event, display cases are either simply placed into position or coupled together by drilling and bolting adjacent cases. In regard to the former method: gaps are usually present between the cases and thereby reduce the attractiveness of the grouping of cases; individual cases will be less steady than several cases coupled together; and the cases, despite careful planning, invariably become inadvertently shifted or cocked which again reduces the attractiveness of the grouped cases. While bolting the cases together alleviates these problems, it also permanently defaces the ends of the cases and thereafter severely limits the way the cases may be otherwise arranged.

SUMMARY OF THE INVENTION

The aforementioned problems are overcome in the present invention, wherein a display case is provided with a unique lighting system which facilitates quick and easy replacement of the panels, and a novel coupling assembly for releasably securing adjacent display cases together without marring or disfiguring the ends.

More specifically, the display case of the present invention includes a lighting system which comprises a light fixture and a corresponding wiring assembly. The light fixture is releasably secured in place via support clips which facilitate easy removal and installation of the fixture without the use of tools or the disassembly of other display case components. In addition, all of the elements of the wiring assembly are removably secured by snap-fit constructions, which also facilitate removal thereof without tools or the disassembly of other portions of the display case. This construction enables the front and end panels to be selectively removed without the use tools and without the need to remove other panels. Further the slip-fit mounting of the light fixture and the snap-fit attachment of the wiring assembly components facilitates a quick and easy panel replacement operation.

Concerning a second aspect of the invention, a coupling assembly is provided for securely, but releasably, coupling two display cases in an end-to-end relationship. More particularly, the coupling assembly includes a plurality of clips which straddle the abutting outer frame segments of the adjacent cases and thereby hold the cases tightly together. Further, a plurality of latches are secured along the bottom of the cases to tightly connect the case together at three different levels. This three-tier arrangement provides a secure connection and ensures that no undue stress is placed on any one of the coupling elements.

By using this coupling assembly, the display cases can be arranged and secured together to form a particular line or pattern in a quick and easy manner. This coupling, then, avoids unsightly gaps between display cases, provides a more secure integrated structure (as compared to a single self-standing display case), and prevents inadvertent shifting of the cases out of position. Further, the coupling elements are effectively hidden from casual observation. Moreover, the coupling is performed without any marring of the visible surfaces of either display case, so that the arrangement can be subsequently modified in any way.

DETAILED DESCRIPTION OF THE PREFERRED EMBODIMENT

Figure 1:
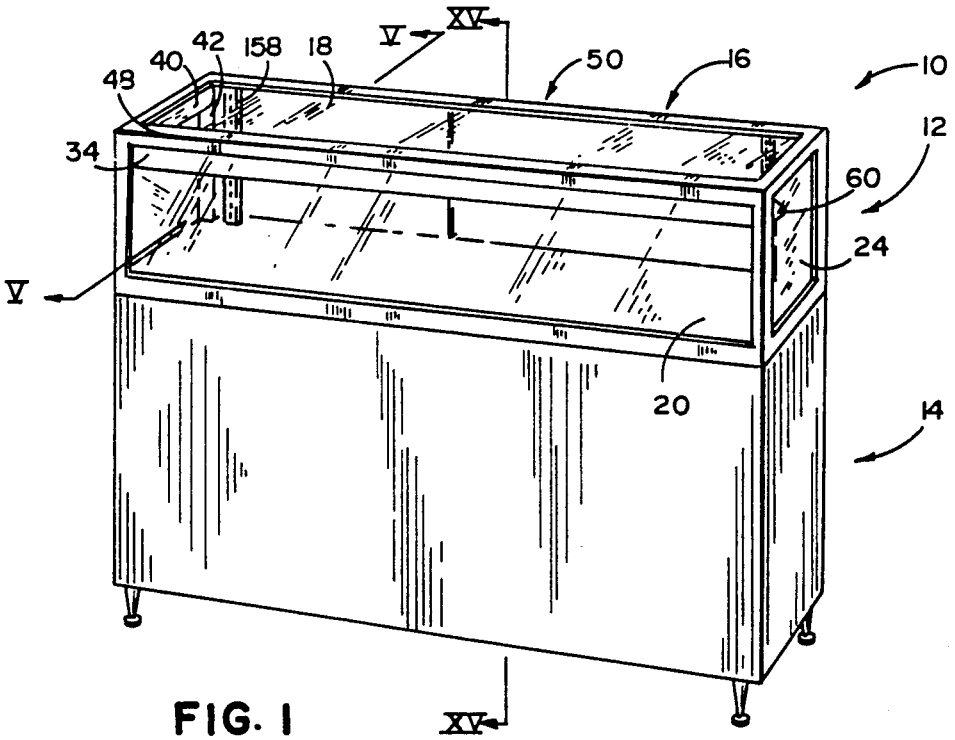
FIG. 1 is a front perspective view of a display case of the present invention.

In the preferred embodiment, a display case 10 is comprised of an upper display portion 12 and a lower base portion 14 (FIG. 1). Display portion 12 includes an integral framework 16, a plurality of panels 18, 20, 22, 24, a deck 26 and rear sliding doors 28. Panels 18, 20, 22, 24 are generally transparent in order to maximize the viewing of the enclosed merchandise. However, there may be occasions, such as for the overall aesthetic view of the display, that one or more panels be translucent or opaque. In any event, the present invention is unaffected by the style of panels used. The basic construction of the display case is the same as that described in copending application Ser. No. 161,902 filed Feb. 29, 1988, and entitled LIGHTED DISPLAY CASE, except as hereinafter differently described.

Figure 2:
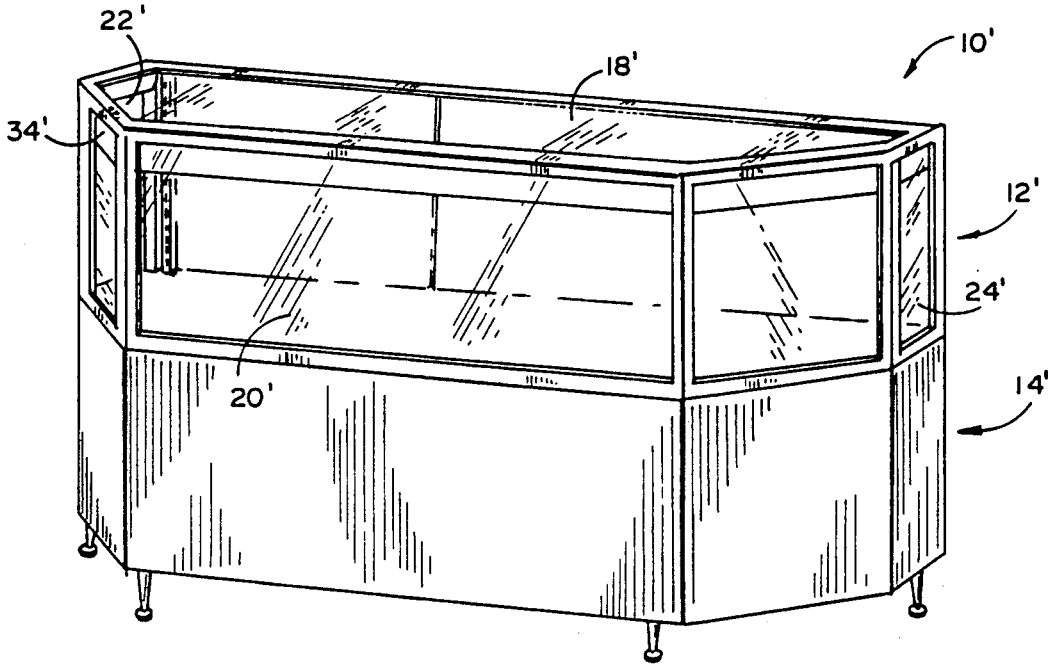
FIG. 2 is a front perspective view of an alternative configuration of a display case in accordance with the present invention.
Figure 4:
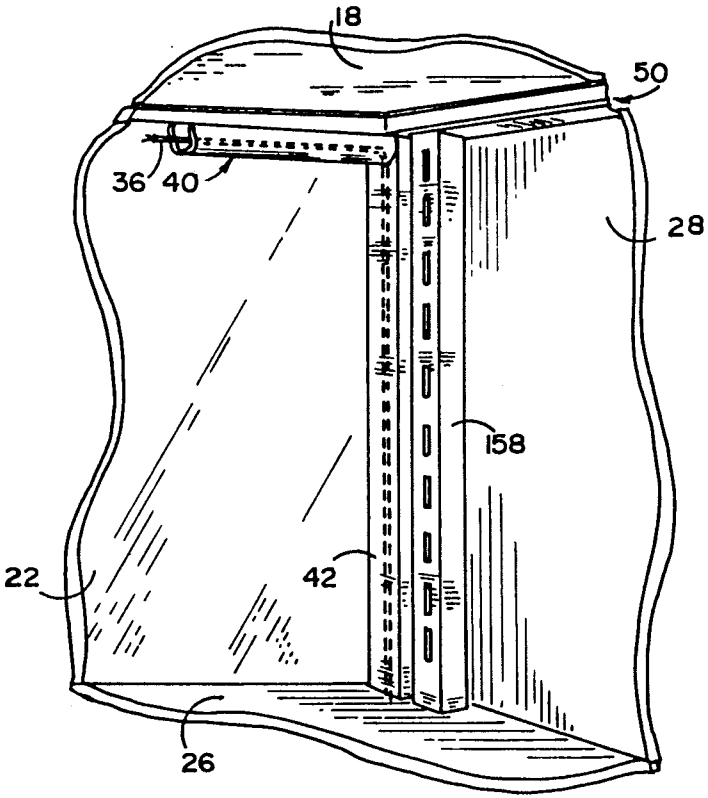
FIG. 4 is a perspective view of an inner rear corner of the display case.

Display cases may be constructed with a variety of shapes other than rectangular, as is illustrated in FIG. 2. As is seen, the alternate embodiment display case 10' is provided with specially shaped panels 18', 20', 22', 24' (FIG. 2). Nevertheless, the present invention is basically unaffected by such changes, except for corresponding changes in the shape and dimensions of the various components interacting with these new configurations.

A lighting system 32 is provided to effectively illuminate the interior of display portion 14 (FIGS. 3, 5–7 and 14–15). Lighting system 32 essentially includes a light fixture 34, an electrical cord 36, and a wiring assembly 38. Wiring assembly 38 includes a backfeed housing 40 and a downfeed channel 42 which cooperate to define a guideway for unobtrusively guiding cord 36 through display case 10 to ballast 44 mounted to the bottom member 46 of base portion 14.

Light fixture 34 is mounted within display case 10 to extend along the upper front edge defined by the front segment 48 of the top frame 50 (defining the upper peripheral framework 16). Fixture 34 (FIGS. 5, 7, 9 and 14) includes an elongated reflector shell 52 having a front wall 54, a top wall 56, a rear wall 58, an end wall 60, and a removal end cap 62. In the most preferred embodiment, reflector 52 is shaped generally as an elongated truncated pyramid. However, a wide variety of shapes could be used. To facilitate the novel slip-fit mounting of fixture 34, shell 52 is further provided with spaced a part slots 64 along the edge 66 defined by front and top walls 54, 56. Slots 64 are adapted to receive therethrough support clips 68, as will be described below.

Light fixture 34 is releasably mounted, in a slip-fit manner, to front segment 48 through its interconnection with two or more spaced apart support clips 68 (FIGS. 5, 7, 9, 10 and 14). Clips 68 ar each formed from a unitary sheet of material bent into a U-shaped mounting portion 70, having inner and outer legs 72, 74 and bight 76, and a projecting support flange 78 extending into the display case from inner leg 72. Preferably, clips 68 are composed of stainless steel, but many other materials having the requisite resiliency and strength could be used.

Figure 5:
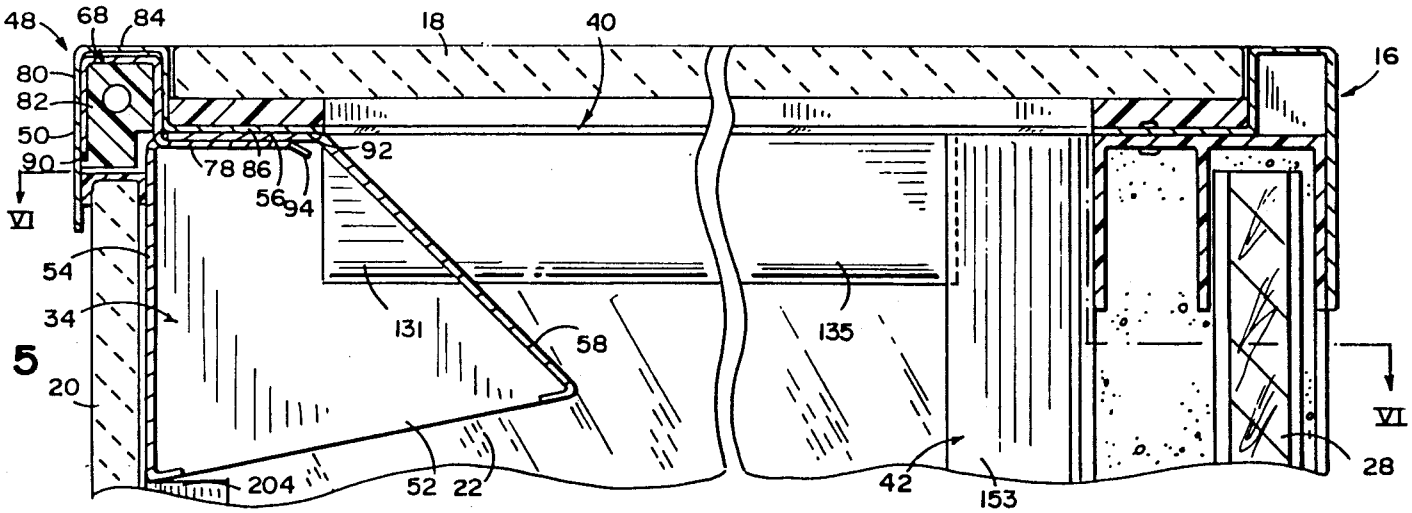
FIG. 5 is a partial cross-sectional view taken along line V—V in FIG. 1.
Figure 7:
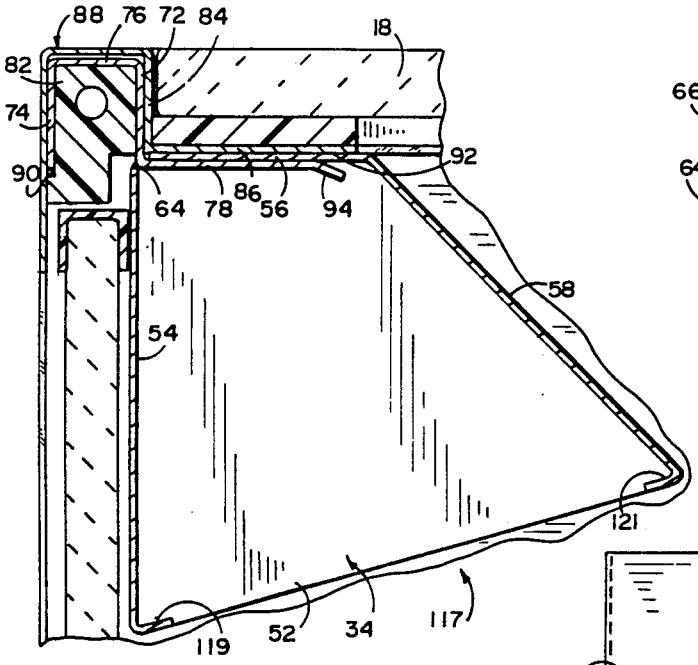
FIG. 7 is a cross-sectional view taken along line VII—VII in FIG. 6.
Figure 8:
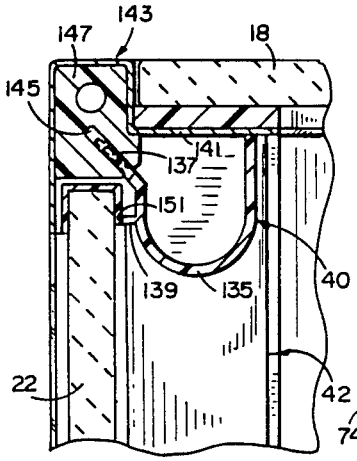
FIG. 8 is a partial cross-sectional view taken along line VIII—VIII 6.
Figure 10:
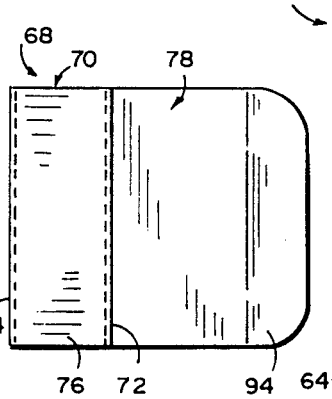
FIG. 10 is a top plan view of one of the support clips mounting the light fixture.
Figure 9:
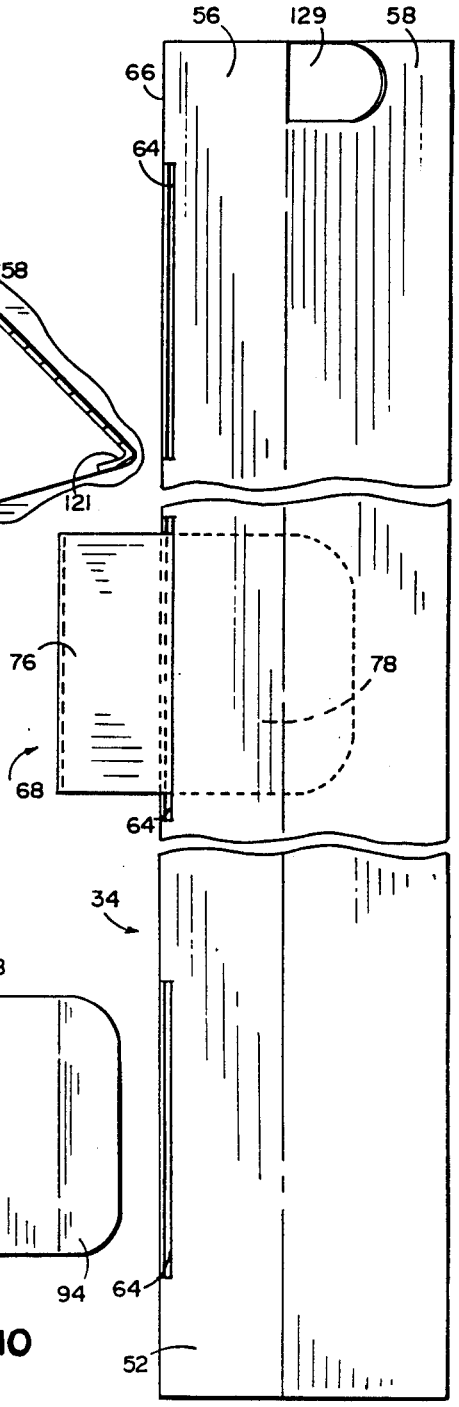
FIG. 9 is a top plan view of the light fixture.
Figure 11:
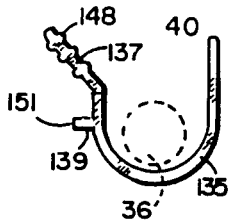
FIG. 11 is an end view of the backfeed housing.
Figure 12:
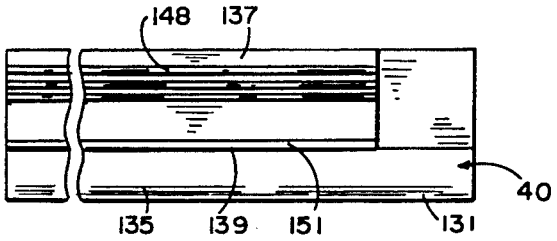
FIG. 12 is a side view of the backfeed channel.

Clips 68 are mounted at spaced-apart locations along front segment 48. Front segment 48 includes a front rail 80 and a rail filler 82. Front rail 80 has a shape similar to clips 68. More specifically, rail 80 includes a U-shaped marginal portion 84 and a projecting platform 86 which supports top panel 18. Rail filler 82 is a block-like component preferably composed of ABS plastic (although other materials may be used). Rail filler 82 is dimensioned for mating receipt within gap 88, defined by marginal portion 84, except where clips 68 are to be mounted (FIGS. 5 and 7). At these clip locations, rail filler 82 is provided with a peripheral recess 90 in the three surfaces engaging marginal portion 84. Recess 90 is shaped and dimensioned to snugly receive the mounting portion 70 of each clip 68 between rail 80 and filler 82. This construction securely holds clips 68 in place.

Support flange 78 of each clip 68 projects outwardly from inner leg 72 at an angle slightly less than 90°, such that flange 78 is biased snugly against the bottom surface 92 of platform 86. To mount fixture 34, support flange 78 of each clip is slipped into a corresponding slot 64 provided in shell 52. Once fully inserted, flanges 78 snugly press top wall 56 of shell 52 against platform 86 to securely grip the reflector against inadvertent release. To facilitate easy mounting of fixture 34, between flange 78 and platform 86, the free end of flange 78 is bent downwardly to define a guiding lip 94.

Figure 3:
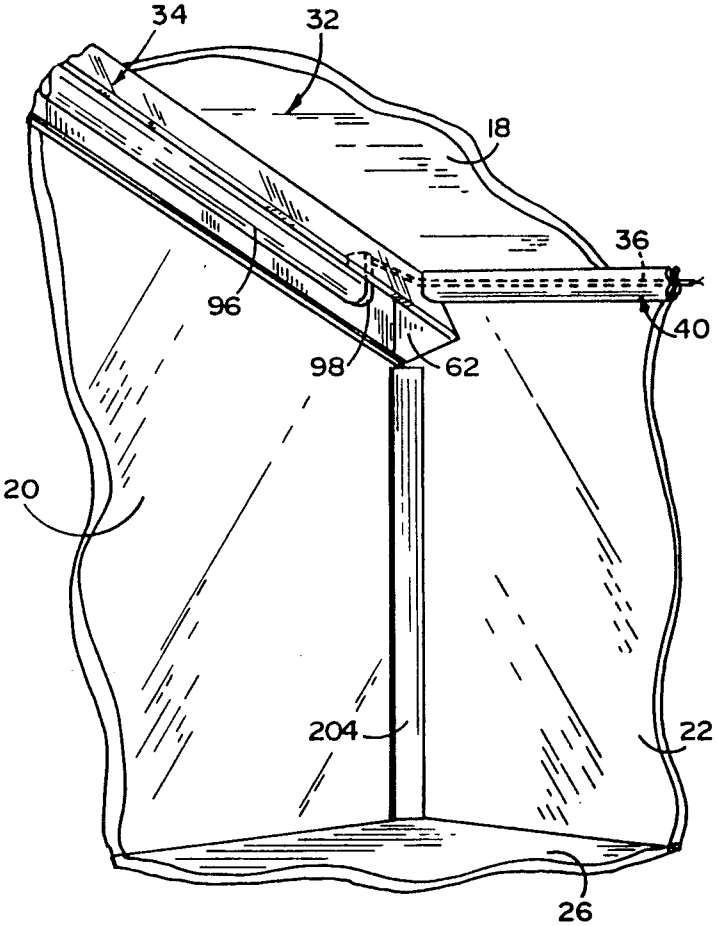
FIG. 3 is a perspective view of an inner front corner of the display case.

To effectively illuminate the interior of display portion 14, one or more lamps 96 (depending on the size of the display case) are secured within fixture 34 (FIG. 3). Lamps 96 are preferably conventional fluorescent tubes supported by sockets 98 extending downwardly from a subframe 101 (FIGS. 19 and 20) received within shell 52 and secured thereto by conventional means (not shown). Of course other types of lamps could be used if desired.

Figure 21:
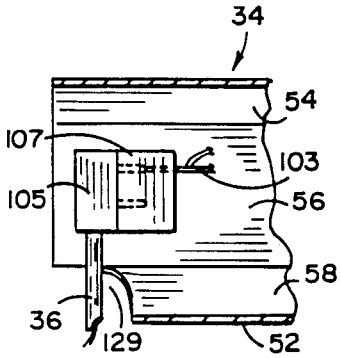
FIG. 21 is a partial cross-sectional view taken along line XXI—XXI in FIG. 20.

To supply power to lamps 96, electrical cord 36 is coupled to a standard arrangement of conductors 103 for fluorescent lighting, positioned within fixture 34. In the most preferred embodiment, cord 36 includes a plug 105 which interfits with a socket element 107 mounted to top wall 56 (FIG. 21). To provide access for the coupling of the plug 105 and the socket 107, the end cap 62 and a slidable shield 109 are removed from one end of the shell 52.

Figure 19:
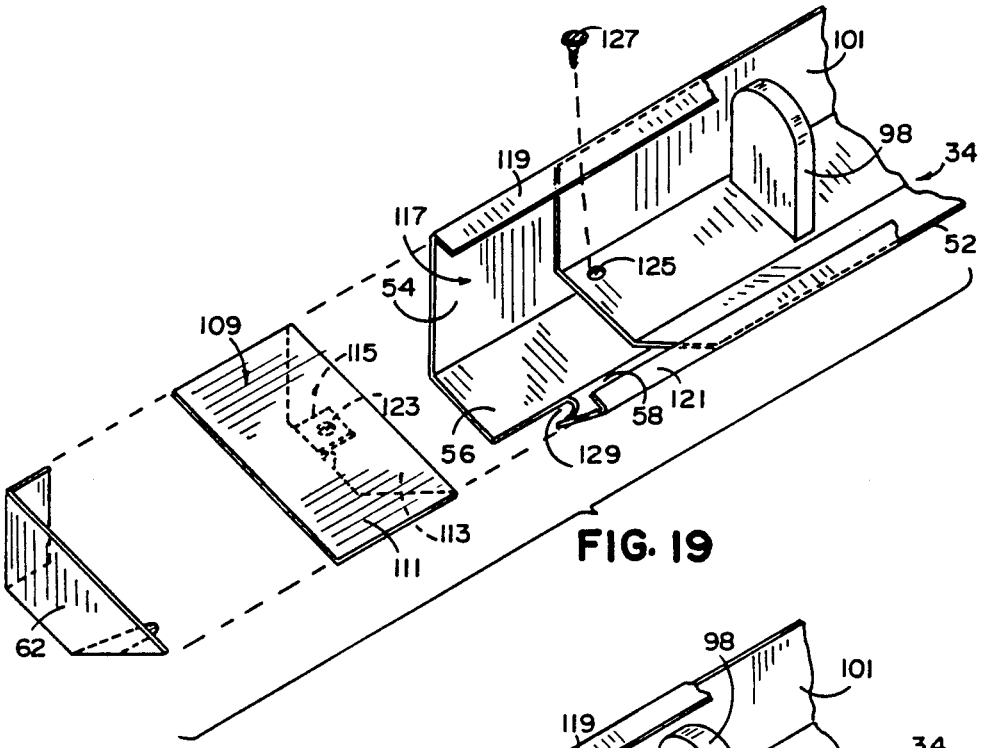
FIG. 19 an exploded perspective view of one end of the light fixture.
Figure 20:
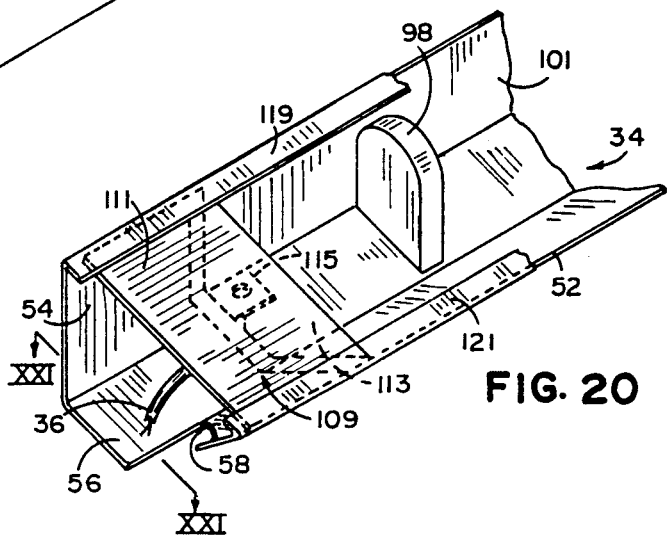
FIG. 20 is a partial perspective view of one end of the light fixture.

The shield 82 is a stepped configuration which is shaped and sized to be slidingly mounted within fixture 34 between a mounted position wherein the shield covers the plug and socket coupling, and a released position wherein the shield is removed from the fixture (FIGS. 19 and 20). More specifically, shield 109 includes a baseplate 111, a medial section 113, and a securing tab 115. Baseplate 111 extends across the opening 117 of shell 52 along the inturned flanges 119, 121. The tapering shape of front and rear walls 52, 58 guide baseplate 111 for longitudinal movement along shell 52. Medial section 113 is bent at right angles to baseplate 111 and extends to a level of subframes 101. Tab 115 lies contiguously against subframe 101 and includes a hole 123 which is adapted to align with a tapped bore 125 in subframe 101 for cooperative receipt of a small retaining screw 127.

Once the coupling of the plug and socket is effected, cord 36 is positioned within an aperture 129, defined in rear wall 58, to pass out of shell 52. As seen in FIG. 21, plug 105 includes prongs which project laterally from cord 36, to more easily direct cord 36 out aperture 129. Aperture 129 is arcuate in shape so as to matingly receive one end 131 of backfeed housing 40, as will be discussed below. Once the coupling is complete and cord 36 lies in aperture 129, shield 109 and cap 62 can be reassembled to fixture 34.

Figure 6:
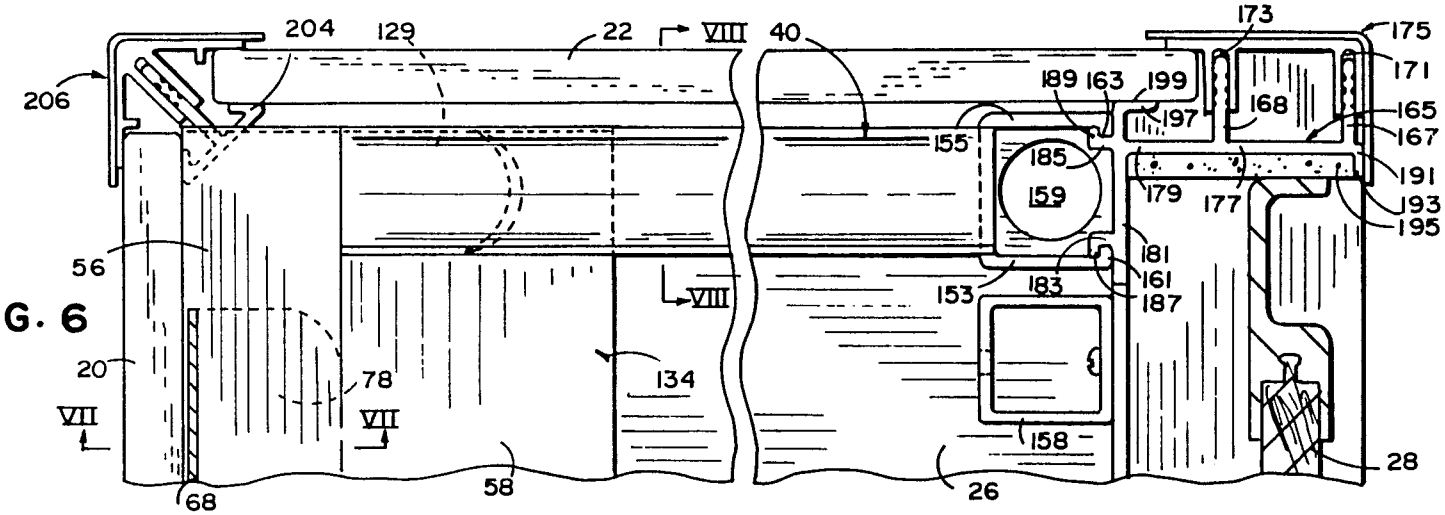
FIG. 6 is a partial cross-sectional view taken along line VI—VI in FIG. 5.
Figure 14:
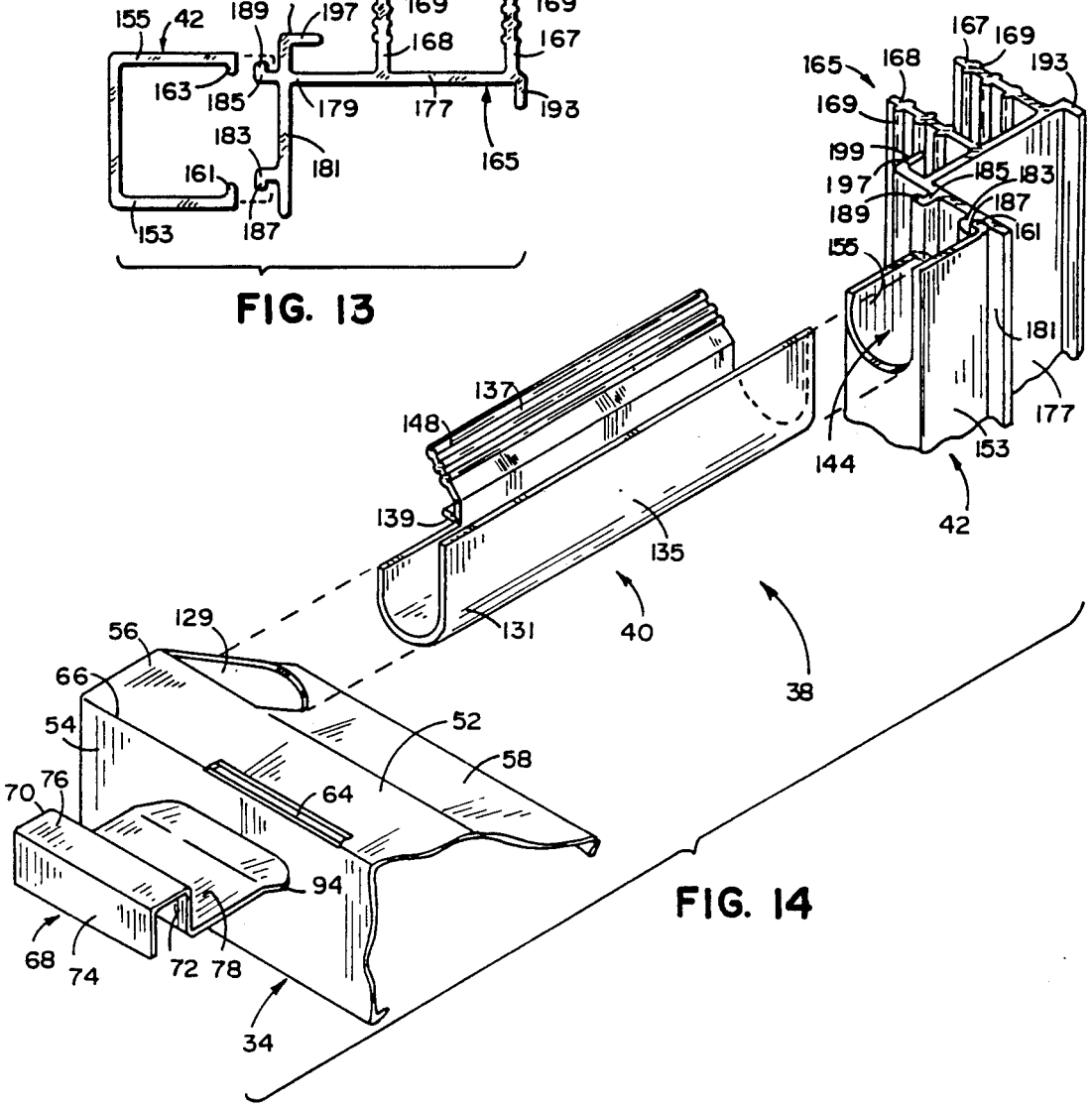
FIG. 14 is an exploded perspective view of the lighting system.
Figure 15:
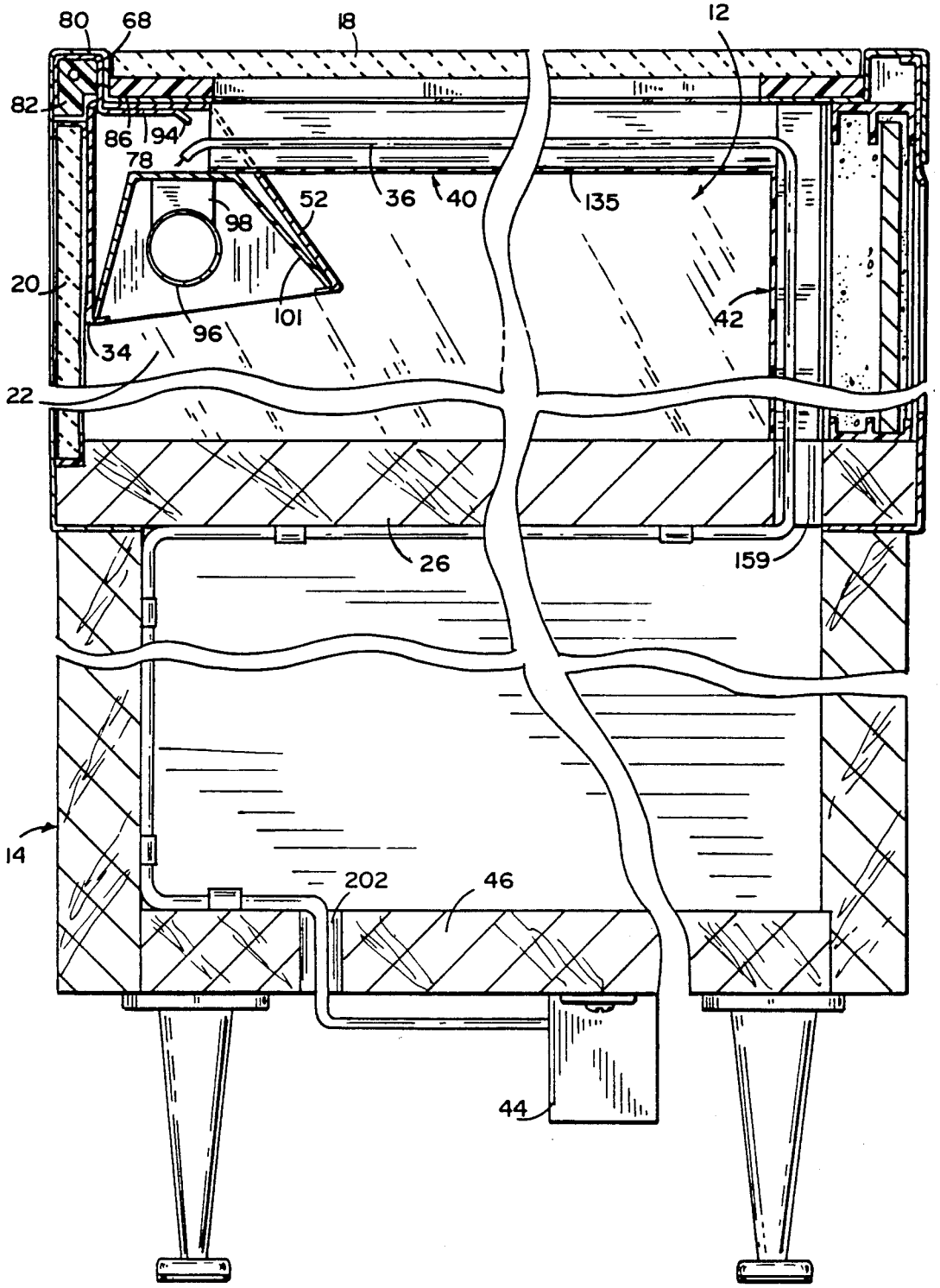
FIG. 15 is a cross-sectional view taken along lines XV—XV in FIG. 1.

Backfeed housing 40 acts to feed cord 36 from the front to the rear of the display case, where it can be fed downwardly to ballast 44 in a less-visible manner (FIGS. 5, 6 and 15). Backfeed housing 40 is an elongate plastic extrusion which includes a trough 135, a mounting arm 137 projecting upwardly at an inclination of approximately 45°, and a laterally extending tang 139 (FIGS. 8, 11, 12 and 14). More particularly, trough 135 is an arcuate generally U-shaped guideway having a diameter slightly larger than the diameter of cord 36, to thereby loosely receive and support the cord therein. In addition, trough 135 cooperates with platform 141 of end rail 143 to not only confine cord 36 within trough 135, but also to conceal it from view. Moreover, trough 135 is dimensioned for mating receipt not only within aperture 129 (as mentioned above), but also in cutout 144 provided in downfeed channel 42 (as will be discussed further below), so that the cord is completely encased and guided as it is fed rearward through display portion 12. Also, to facilitate the receipt of trough 135 within aperture 129, arm 137 and tang 139 are removed from end 131.

Backfeed housing 40 is held in its proper position and orientation through the cooperative effort of arm 137 and tang 139. Firstly, arm 137 projects upwardly into a corresponding groove 145 provided longitudinally in end rail filler 147. Arm 137 is further provided with a series of barbs 148 which increase the frictional interconnection of arm 137 in groove 147, so as to avoid any unwanted sagging or slippage of housing 40. Secondly, tang 139 projects laterally outward such that its distal end 151 presses against end panel 122 to help stabilize trough 135 against twisting or other disorientation.

Additionally, and perhaps more importantly, tang 139 also functions to hold the upper portion of end panel 2 in place. More specifically, the combination of arm 137 being inserted in groove 145, and trough 135 being received in aperture 129 and cutout 144, effectively precludes housing 40 from experiencing any significant lateral movement. The engagement of tang 139 against end panel 22, then, eliminates an additional mounting member typically needed to support the upper portion of end panel 22.

Once cord 36 has been fed to the rear of display case 10, it is then directed downwardly through downfeed channel 42 (FIGS. 5, 6, 14 and 15). Downfeed channel 42 is a generally rectangular U-shaped plastic extrusion having a pair of legs 153, 155 and an interconnecting bight 157. The U-shaped configuration of the channel makes it appear very similar to the adjacent slotted bracket 158 provided to support shelves (not shown). This arrangement provides a less noticeable construction than most prior art structures. Once cord 36 passes through aperture 159 in deck 26, it is directed through another hole 202 in bottom member 46 to facilitate its attachment with ballast 44. The cord, underneath deck 26, is out of display area 12 and hidden from view, such that it no longer needs a constraining guideway. Downfeed channel 42 is releasably secured to a rear bracket 165 by rounded inturned knobs 161, 163 formed on the free ends of legs 153, 155 (FIGS. 6 and 13). preferably, downfeed channel 42 extends vertically through the entire height of display portion 12 so as to contain cord 36 along the entire length from backfeed housing 40 to aperture 159 provided in deck 26.

Figure 13:
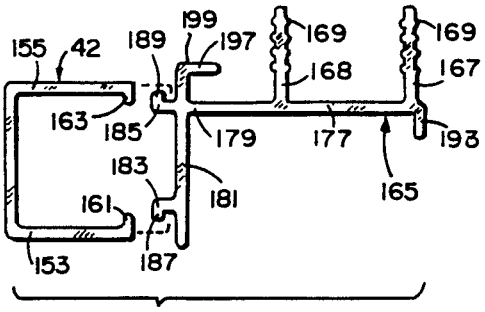
FIG. 13 is an exploded top view of the downfeed channel and rear bracket.

Rear bracket 165 is a plastic extrusion having a pair of laterally extending mounting ridges 167, 168 each having a series of barbs 169 which are adapted for receipt within a pair of elongated recesses 171, 173 formed in the rear upstanding frame member 175 (FIGS. 6, 13 and 14). The mounting ridges 167, 168 each extend from a central plate 177. This construction permits easy installation and removal of bracket 165 without the use of tools. As described more fully below, this easy release of bracket 165 permits an easy removal operation for end panel 22.

Secured orthogonally to the forward end 179 of central plate 177 is a channel attaching plate 181. Attaching plate 18 includes a pair of spaced apart fins 183, 185 each having a rounded outturned knob 187, 189. Outturned knobs 187, 189 interact with inturned knobs 161, 163 on channel 42, such that channel 42 may be snap-fit onto fins 183, 185. Installation and removal of channel 42 is easily accomplished, then, by the rounded surfaces on knobs 161, 163, 187, 189 and the inherent flexibility of legs 153, 155.

Projecting outwardly from the rearward end 191 of central plate 177 is a short foam-mounting plate 193. Foam-mounting plate 193 in conjunction with central plate 177 and attaching plate 181 defines a shallow channel which receives a foam cushion 195. Cushion 195 acts as a bumper for the rear sliding doors 28. Foam cushion 195 is typically secured in place through the use of a well-known adhesive.

Extending orthogonally from the outward end of attaching plate 181, and in general parallel relationship with central plate 177, is a panel retaining plate 197. Panel retaining plate 197 includes an outer face 199, having a slip-resistant surface, which in conjunction with upstanding frame member 175 traps and secures the rearward edge of end panel 22 therebetween.

To remove front panel 20, it is no longer necessary to remove top panel 18 and unbolt fixture 34 from platform 86. Instead, the user is merely required to manually slip shell 52 from support clips 68 and arm 137 of backfeed housing 40 from groove 145. These components—fixture 34 and housing 40—can be removed quickly and easily without any special skill or tools. After their removal, cord 36 has sufficient slack such that the components can be laid out of the way on deck 26. Thereafter, the user need only remove the corner supports 204 engaged in the front upstanding frame members 206 (in the same manner as arm 137 is engaged in groove 145) to effect removal of front panel 20. At this point, front panel 20 may be easily tipped inwardly and removed from the display case.

Figure 16:
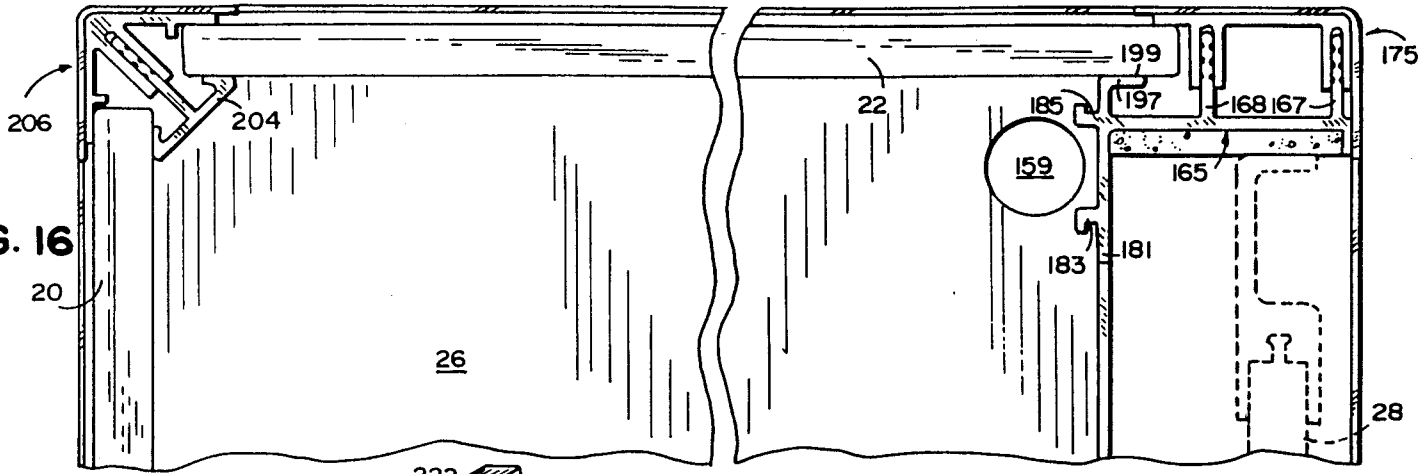
FIG. 16 is the partial cross section of FIG. 5 with components removed to facilitate replacement of one of the end panels.

Similarly, end panel 22 may also be removed in a quick and easy manner. More particularly, fixture 34, backfeed housing 40 and corner support 204 are all removed in the same manner as discussed above and laid out of the way on deck 26. Additionally, it will also be necessary to remove downfeed channel 42 and rear bracket 165 (FIG. 16). However, as with the former components, these also have a snap-fit mounting construction which facilitates a quick manual removal thereof without the use of special skills or tools. Once these components are removed end panel 22 may be tipped inwardly and removed without requiring the removal of any other panels of the display case. Occasionally, it may be possible to remove end panel 22 without the removal of rear bracket 165 depending on the tolerances between the end panel 22, upstanding rear frame member 175, and panel retaining plate 197.

Figure 18:
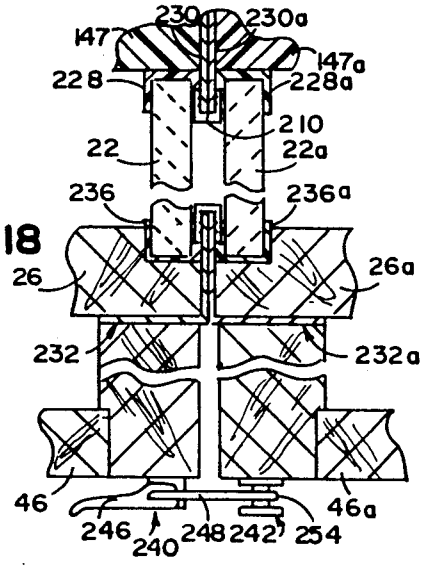
FIG. 18 a cross-sectional view of two display cases coupled together.
Figure 17:
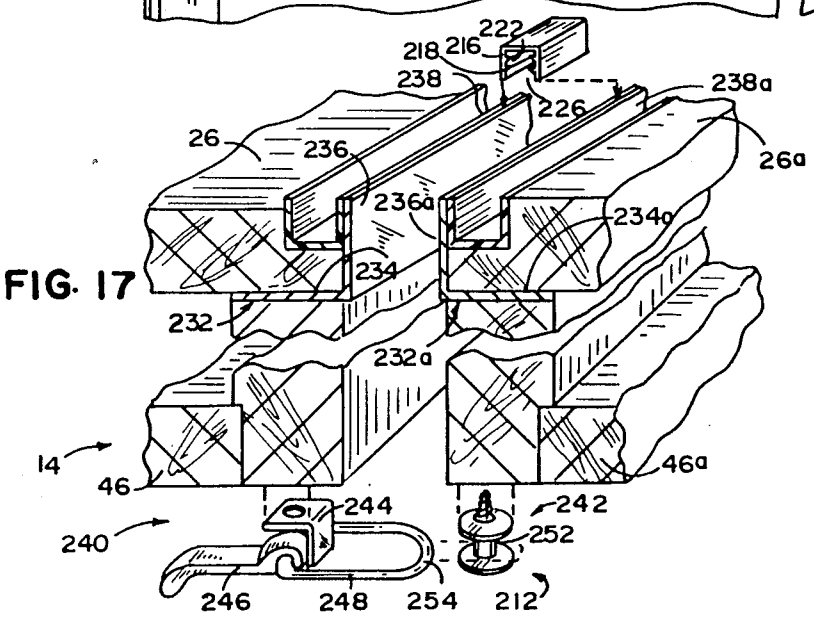
FIG. 17 is an exploded perspective view of a coupling clip coupling the lower frames of two adjacent display cases.

An additional aspect of the present invention involves the coupling of adjacent display cases 10, 10*a* in an end-to-end relationship. The secure and easy coupling of the display cases 10, 10*a* is achieved through the use of a plurality of coupling clips 210 and latches 212 (FIGS. 17 and 18).

Each display case 10, 10*a*, is provided with a framework 16, 16*a* having a top frame 50, 50*a* which includes an upper end rail 143, 143*a*, identical in cross-section to the previously described front rail 80. The marginal portions 224, 224*a* of end rail 143, 143*a* define gaps 126, 126*a* in which is received fillers 147, 174*a*, elastomeric gaskets 228, 228*a* and end panels 22, 22*a*. When the display cases 10, 10*a* are placed in end-to-end relation, the outer legs 230, 230*a* of rails 143, 143*a* are in abutment with each other. Frameworks 16, 16*a* also include lower end frame members 232, 232*a*, Which are L-shaped and each include a horizontal section 234, 234*a* for supporting decks 26, 26*a*, and a vertical section 236, 236*a*. Vertical sections 236, 236*a* in cooperation with decks 26, 26*a*, also define grooves into which are received the bottom edges of end panels 22, 22*a* surrounded by elastomeric gaskets 238, 238*a*. In like manner to the upper end rails 143, 143*a*, vertical sections 236, 236*a* are placed in abutment with each other when display cases 10, 10*a* are placed in abutting end-to-end relation.

Coupling clips 210 are thin, longitudinally short generally U-shaped members having arms 214, 216 provided with teeth 218 along the opposed inner faces 220, 222. Coupling clips 210 are adapted to straddle short segments of the frame members of the abutting display cases 10, 10*a*. More specifically a pair of spaced apart coupling clips 210 are received over the abutting legs 230, 230*a* of top frames 50, 50*a*, such that legs 230, 230*a* are received and tightly held within the gaps 232 defined by clips 210. Also, along lower frame members 232, 232*a* coupling clips 210 straddle the abutted vertical sections 236, 236*a* to tightly hold and retain the frame members in gap 226. As can be readily appreciated, teeth 218 increase the strength of the coupling and effectively alleviate any undesirable slippage of clips 210.

Coupling clips 210 are installed and removed with end panels 22, 22*a* removed. Their insertion may be easily accomplished by a simple manual pressure. Their removal will generally require a screwdriver or other implement by which they may be pried loose. When panels 22, 22*a* are reinserted, the surrounding elastomeric gaskets 228, 228*a*, 238, 238*a* is compressed sufficiently to permit the additional space occupied by the thin clips 210.

In addition, along bottom members 46, 46*a* of bases 14, 14*a* are a plurality of latches 212. Each latch includes a pair of complementary latch elements 240, 242. One latch element 240 is fixedly secured to bottom member 46 and includes a base 244, a handle 246 pivotally mounted to base 244, and a loop 248 pivotally secured to handle 246. Corresponding latch element 242 is secured to the bottom 246*a* of the adjacent display case 10*a* and includes a fixed body 250 having a recess 252. Recess 252 is adapted to receive the bight portion 254 of loop 248. The latches are of a well-known type and operate in a conventional over-center manner and will therefore not be further described.

This unique coupling of adjacent display cases 10, 10*a* is an end-to-end relationship, is provided at three elevational levels. This three-tier system provides a secure arrangement which is not susceptible to inadvertent release or wobbling. Also, by using such a three-tier system, excessive stress generated in clips 210 or latches 212, by undesirable moment forces, are effectively alleviated. Further, by inserting clips 210, as discussed above, between display cases 10, 10*a*, and by mounting latches 212 on the underside of bases 14, 14*a*, the coupling assemblies are essentially hidden from casual viewing of the display cases.

The above description is that of a preferred aspect of the invention. Various alterations and changes can be made without departing from the spirit and broader aspects of the invention which are defined in the appended claims, which are to be interpreted in accordance with the principles of patent law, including the Doctrine of Equivalence.

We claim:

1. A display case assembly comprising:

a pair of display cases each including a framework having a top frame and a bottom frame, a plurality of panels, and a base supporting said framework and said panels, said base including a bottom member having an undersurface hidden from view, said display cases being positioned against one another such that said top frames and said bottom frames include portions in abutting relation with one another, said bottom members disposed adjacent to one another;

a plurality of short coupling clips, at least one of said clips engaging and securing together short segments of said abutting portions of said top frames, and at least one of said clips engaging and securing together short segments of said abutting portions of said bottom frames; and at least one latch element connected to said undersurface of each of said bottom members generally hidden from view, said latch elements being complementary in shape such that the latch element of one display case is adapted to engage and lock with the latch element of the other display case;

whereby said display cases are securely engaged together to form an integral display case assembly.

2. A display case assembly as defined in claim 1 wherein each said clip has a substantially U-shaped configuration which defines a gap, and wherein each said clip is adapted to straddle a pair of said short segments of said abutting frame portions and snugly receive said abutting portions in said gap.

3. A display case assembly as defined in claim 2 wherein said clips are further provided with a pair of opposed inwardly directed faces defining said gap, and wherein said faces are provided with teeth which engage said short segments of said abutting frame portions for secure attachment of said clips thereto.

4. A display case assembly comprising:

a pair of display cases each including a framework having a top frame and a bottom frame, a plurality of panels, and a base supporting said framework and said panels and having an undersurface hidden from view, said display cases being positioned against one another such that said top frames include portions in abutting relation with each other, said bottom frames include portions in abutting relation with each other, and said bases include portions in close proximity to one another;

first means for releasably coupling said abutting portions of said top frames comprising a first coupling clip engaging and securing together said abutting portions of said top frames;

second means for releasably coupling said abutting portions of said bottom frames comprising a second coupling clip engaging and securing together said abutting portions of said bottom frames; and third means for releasably coupling said portions of said bases in close proximity to one another comprising a pair of hidden latch elements, each of said pair of latch elements connected to a said undersurface of one of said bases, said latch elements being complementary in shape such that the latch element of one display case is adapted to engage and lock with the latch element of the other display case.

5. A display case assembly as defined in claim 4 wherein said first and second releasable coupling means each include at least one short generally U-shaped clip which is adapted to straddle and engage a short segment of one of said frame abutting portions.

* * * * *